US011268499B2

(12) United States Patent
Chmatil et al.

(10) Patent No.: US 11,268,499 B2
(45) Date of Patent: Mar. 8, 2022

(54) MANUAL DISPLACEMENT CONTROL ARRANGEMENT FOR AN AXIAL PISTON PUMP

(71) Applicant: Danfoss Power Solutions GmbH & Co. OHG, Neumünster (DE)

(72) Inventors: Miroslav Chmatil, Nová Dubnica (SK); Jan Jakubovic, Zilina (SK); Lubos Chmatil, Nová Dubnica (SK); Peter Krissak, Zilina (SK)

(73) Assignee: Danfoss Power Solutions GmbH & Co. OHG, Neumunster (DE)

( * ) Notice: Subject to any disclaimer, the term of this patent is extended or adjusted under 35 U.S.C. 154(b) by 268 days.

(21) Appl. No.: 16/346,209

(22) PCT Filed: Nov. 13, 2017

(86) PCT No.: PCT/EP2017/079028
§ 371 (c)(1),
(2) Date: Apr. 30, 2019

(87) PCT Pub. No.: WO2018/114141
PCT Pub. Date: Jun. 28, 2018

(65) Prior Publication Data

US 2020/0056580 A1 Feb. 20, 2020

(30) Foreign Application Priority Data

Dec. 22, 2016 (DE) ..... 10 2016 226 039.1

(51) Int. Cl.
*F04B 1/295* (2020.01)
*F04B 1/324* (2020.01)
(Continued)

(52) U.S. Cl.
CPC ..... *F04B 1/295* (2013.01); *F04B 1/146* (2013.01); *F04B 1/324* (2013.01); *F04B 49/002* (2013.01);
(Continued)

(58) Field of Classification Search
CPC ..... F04B 1/146; F04B 1/295; F04B 1/324; F04B 9/042; F04B 49/002; F04B 49/08;
(Continued)

(56) References Cited

U.S. PATENT DOCUMENTS 3,139,037 A * 6/1964 Budzich ..... F01B 3/107 91/483
3,161,137 A * 12/1964 Hardwicke ..... F16H 61/439 417/307
(Continued)

FOREIGN PATENT DOCUMENTS

CN 1333430 A 1/2002
CN 1705827 A 12/2005
(Continued)

OTHER PUBLICATIONS

International Search Report For Serial No. PCT/EP2017/079028 dated Feb. 3, 2018.

*Primary Examiner* — Alexander B Comley
(74) *Attorney, Agent, or Firm* — McCormick, Paulding & Huber PLLC

(57) ABSTRACT

Displacement control device for variably adjusting the displacement of an axial piston hydraulic pump including a rotary shaft rotatable around a shaft axis. A torque can be applied for rotating the rotary shaft to open and close servo pressure lines to adjust the displacement volume of the axial piston hydraulic pump. Concentric to the shaft axis in a mid-portion of the rotary shaft a detent sleeve is positioned having an abutment area onto which, in the neutral position,
(Continued)

a sliding element abuts. The detent sleeve, in operating conditions is rotatably fixed with the rotary shaft and turns with the rotary shaft and for neutral position adjustments in non-operating conditions, the detent sleeve and the rotary shaft are detachable from each other such that the rotary shaft can be turned relative and independently within the detent sleeve, which is held in its neutral position by the sliding element.

20 Claims, 7 Drawing Sheets

(51) Int. Cl.

| | |
|---|---|
| ***F04B 49/00*** | (2006.01) |
| ***F04B 49/12*** | (2006.01) |
| ***F04B 1/146*** | (2020.01) |
| *F03C 1/40* | (2006.01) |
| *F04B 49/08* | (2006.01) |

(52) U.S. Cl.
CPC ..... *F04B 49/12* (2013.01); *F03C 1/0686* (2013.01); *F04B 49/08* (2013.01)

(58) Field of Classification Search
CPC ..... F04B 49/12; F03C 1/0686; F01B 3/102; F01B 3/106
USPC ..... 417/222.1; 91/505; 92/13; 137/525.12, 137/625.15, 625.16
See application file for complete search history.

(56) References Cited

U.S. PATENT DOCUMENTS 3,282,225 A * 11/1966 Moon, Jr. ..... F04B 1/324 60/452
3,429,225 A * 2/1969 Keyworth ..... F01B 3/106 91/3
3,512,178 A * 5/1970 Russell ..... F04B 1/324 417/213
3,911,792 A * 10/1975 Heyl ..... F04B 1/324 91/505
4,017,219 A * 4/1977 Born ..... F04B 1/324 417/216
5,122,037 A * 6/1992 Myers ..... F04B 1/324 417/222.1
5,226,349 A * 7/1993 Alme ..... F04B 1/324 91/506
5,273,403 A * 12/1993 Im ..... F04B 1/324 417/213
5,297,941 A * 3/1994 Park ..... F04B 1/324 417/218
6,030,182 A * 2/2000 Voigt ..... F04B 1/324 417/222.1
6,158,969 A * 12/2000 Graf ..... F04B 1/324 137/83
6,684,634 B1 * 2/2004 Sakamoto ..... F04B 1/22 60/444
8,943,949 B2 * 2/2015 Thoms ..... F04B 49/12 91/505
2008/0041223 A1 * 2/2008 Takahashi ..... F04B 1/22 91/505
2012/0234400 A1 * 9/2012 Ishikawa ..... F16K 5/0414 137/209

FOREIGN PATENT DOCUMENTS

| | | | | |
|---|---|---|---|---|
| CN | 104514763 | A | 4/2015 | |
| CN | 105840566 | A | 8/2016 | |
| DE | 4125706 | C1 * | 1/1993 | ..... F04B 49/12 |
| DE | 4125706 | C1 | 1/1993 | |
| DE | 196 08 228 | A1 | 9/1997 | |
| DE | 102012200217 | B4 | 1/2015 | |
| DE | 102015202406 | A1 | 8/2015 | |
| JP | H10-331773 | A | 12/1998 | |
| JP | 2000-297743 | A | 10/2000 | |
| JP | 2009-243435 | A | 10/2009 | |
| JP | 2013530345 | A | 7/2013 | |
| JP | 2015140785 | A | 8/2015 | |

* cited by examiner

MANUAL DISPLACEMENT CONTROL ARRANGEMENT FOR AN AXIAL PISTON PUMP

CROSS-REFERENCE TO RELATED APPLICATIONS

This application is a National Stage application of International Patent Application No. PCT/EP2017/079028, filed on Nov. 13, 2017, which claims priority to German Patent Application No. 10 2016 226 039.1, filed on Dec. 22, 2016, each of which is hereby incorporated by reference in its entirety.

TECHNICAL FIELD

The invention relates to a displacement control device for variably adjusting the displacement of an axial piston hydraulic pump, in particular to a manual displacement control device. The displacement control device according to the invention and to the preamble of claim 1 comprises a rotary shaft which is mounted in a housing and is rotatable around a rotary shaft axis of the rotary shaft. The rotary shaft has a first end and a second end, wherein to the second end, which protrudes outside of the housing, a torque can be applied for rotating the rotary shaft to open and close servo pressure lines arranged within the housing. These servo pressure lines can conduct hydraulic fluid to and from a servo adjusting unit capable of adjusting the displacement volume of the axial piston hydraulic pump. The rotary shaft further comprises a mid-portion located between the first end and the second end.

BACKGROUND

The invention relates in particular to the adjustment of the neutral setting of a control device in hydrostatic adjustment devices of hydraulic machines in which both the displacement volume and the delivery direction are adjustable. The invention relates in particular also to feed back the displacement volume and the delivery direction to the displacement control device after a change of displacement angle for the axial piston hydraulic pump is set by an operator or a (external) control unit of the hydrostatic transmission.

Hydraulic servo units are used in a variety of designs for the adjustment of the displacement volume of hydraulic pumps. Thereby, the position of a servo piston in such a servo unit is controlled with hydraulic fluid under pressure applied to one side of that servo piston, where upon the position of the servo piston determines the position of the displacement device of the hydraulic machine, for example the swivelling angle of a swash plate or a bent axis of an axial piston hydraulic machine. The invention can be used for controlling the servo piston's position in the servo unit. Additional fields of application are for example the control of radial piston machines whose eccentricity is adjustable, or for example in bent axis pumps which power can be modified by deflection of the cylinder block axis. Normally, servo pistons which are acting on adjustment/displacement devices of the hydraulic machines are centred in the servo cylinders in their neutral or zero position via springs. As a result of which in the case of balanced pressure conditions, for example, on a double-sided servo piston, the delivery flow of the hydraulic machine is zero. This is known for e.g. from a generic device according to DE 41 25 706 C1, whose features constitute the preamble of claim 1. A similar displacement control device that allows a fine adjustment of the neutral position of an adjustable hydraulic machine is described in DE 10 2012 200 217 B4.

The zero delivery volume corresponds, for example, to a machine standstill of a hydraulic driven machine, i.e. the hydraulic pump in this condition neither emits nor receives power. Such a machine standstill is of safety significance and must therefore be definable precisely by the control device. The control device for a servo unit commanding the displacement of a displacement element, like a swashplate, is responsible for the pressures on both sides of the servo piston and controls the respective hydraulic pressures to the servo piston via its control edges. If an operator or a (external) control unit of a hydrostatic transmission, for example, demands the transmission to a standstill, this has to be achieved securely in order to avoid accidents. This is why the hydraulic neutral position of the control device is of high security relevance, thus the standstill of the hydraulic machine necessarily must be adjustable precisely. To achieve this, the displacement control device has to be settable on a neutral position indication, which reliable commands the hydraulic machine or the hydrostatic transmission to zero displacement, i.e. to a standstill.

However, in practice, both the control device and the servo unit, in particular its control edges are subjected to production tolerances, as a result of which the neutral position of the control device usually deviates from the theoretical predefined position. As a result, the servo piston at the predefined neutral position of the control device can be in an deflected position and the adjustable hydraulic pump would be outside of the zero displacement condition, thus machine standstill could not be achieved. Hence, a mechanism for neutral setting is necessary to compensate the position error in the control device and/or the servo unit caused by production tolerances so that the hydraulic pump facilitates the zero position of the servo piston in the neutral position of the control device and thus machine standstill can be achieved reliable.

By means of a neutral setting-adjustment it is ensured that in the case of a reported position of the servo system in which the hydraulic machine does not produce any delivery flow, no control signal counteracting this state is generated in the control unit. Otherwise the setting of the control device does not match the setting of the servo piston in the displacement device of the hydraulic machine. In any other case machine standstill can never be achieved, since one of the two units is always outside of the hydraulic centre. A neutral adjustment for the control device has the task of centring the control piston in the control device.

In particular, for mechanical adjustments this means that the deflection of the control device in one direction should be precisely as great in amount as in the other direction so that the delivery power generated by the variable hydraulic machine or received by the variable hydraulic machine is equally great for both delivery directions, i.e. symmetric. In particular, a forward-reverse driving or a left-right pivoting is to be thought of here, which should take place with the same power. For different reasons, in particular for safety reasons and for reasons of user friendliness, an input shaft should always autonomously strive to return to its neutral position. By way of illustration the machine operator expects that the deflected control lever autonomous-ly swivels back to the neutral position after being released. This, for example, is achieved in the state of the art by a permanently acting spring forces onto the control piston in the control device.

In the case of a design of such a neutral setting mechanism known from DE 41 25 706 C1 the input shaft, which can be turned mechanically in two directions, exhibits a flattened portion upon which a spring-loaded and guided sliding part acts. The sliding part exhibits a likewise planar surface on the contact surface between the flattened portion and the front face of the sliding part. As a result of which in the event of turning the input shaft out of the neutral position a later-al contact on the flattened portion of the input shaft occurs. Through the spring action which acts on the sliding part an outer axial force is generated as an aligning torque on the input shaft. This aligning torque attempts to move the input shaft back to its neutral position in which the two areas, the planar front face of the sliding part and the planar flattened portion on the input shaft, lie flat, fully-faced or planar on one another. In this planar, fully-faced contact the spring action acts directly in direction towards the axis of the input shaft, so that no torque is generated by the spring action. Through the flat contact of the sliding part on the flattened portion of the input shaft, regardless of the direction of rotation of the shaft the sliding part is shifted away from the axis of the input shaft and the surface contact is changed to a line contact eccentric to the shaft axis, seen in direction of the spring force. As a result of that, a torque is acting in one or the other direction intending to turn back the input shaft to its neutral position. If the deflection torque on the input shaft applied by a machine operator or a control unit is zero or is lower than the torque which is generated by the shifted sliding part via the flattened portion on the input shaft, the input shaft rotates driven by the spring force back to its neutral position.

For the setting/adjusting of the neutral position of the control device the known design of DE 41 25 706 C1 proposes shifting the relative position of a linking lever, which links the input shaft with a control piston of the displacement control device, by means of an eccentric mounted lever head abutting on the control piston. With this the neutral position of the control piston in the control cylinder can be adapted to the neutral position of the input shaft.

SUMMARY

It is an object of the present invention to provide an apparatus for a displacement control device of the above mentioned kind that allows a precise setting of the neutral position of the control apparatus for adjusting the volumetric flow rate of hydraulic pumps to zero when the machine is at a standstill. Furthermore, it is an object of the invention to specify a setting mechanism for the neutral position of a displacement control and thereby of the hydraulic pump, which setting mechanism requires just a few components, with which a simple and quick neutral setting adjustment can be realized every time needed and not only once, when the hydraulic piston pump is placed into operation. The construction thereof should be simple, robust and cost effective. Furthermore, it is also an object of the invention to provide a reliable feedback of the position of the displacement element with regard to the setting in the displacement control device.

The object of the invention is solved by a displacement control device for a hydraulic piston pump according to the preamble of claim 1. For adjusting the displacement volume of a hy-draulic piston pump a rotary shaft is mounted in a housing of the displacement control device and is rotatable around a shaft axis of the rotary shaft. The rotary shaft having a first end and a second end, wherein to the second end, which protrudes outside of the housing, a torque can be applied for rotating the rotary shaft to open and close servo pressure lines arranged within the housing. This servo pressure lines can conduct hydraulic fluid to and from a servo adjusting unit capable to adjust the displacement volume of the hydraulic piston pump. The rotary shaft further comprises a mid-portion located between the first end and the second end. Concentric to the shaft axis in the mid-portion of the rotary shaft a detent sleeve is positioned comprising an abutment area onto which, in the neutral position of the displacement control device, a sliding element abuts. The sliding element is mounted pre-stressed in the housing exerting a resilient force transverse to the shaft axis onto the detent sleeve. In operating conditions of the displace-ment control device the detent sleeve is rotatable fixed with the rotary shaft and turns with the rotary shaft. For neutral position adjustments in non-operating conditions, the detent sleeve and the rotary shaft are detachable from each other such that the rotary shaft can be turned relative and independently within the detent sleeve which is held in its neutral position by the transverse force of the sliding element onto the abutment area.

The construction of a displacement control device according to the invention enables a simple but precise setting of the neutral position of the displacement control device in line with the neutral position of the hydraulic piston pump, as the neutral setting/adjustment of the rotary shaft can be done whilst the detent sleeve is held by the sliding element in a rotational fixed position.

Hence, with the detent sleeve held in position and as such rotationally fixed by means of the sliding element and, simultaneously, with the hydrostatic piston pump in zero position, which is fed back to the displacement control unit for instance by a feedback pin fixed to the displace-ment element of the hydrostatic piston pump, a continuous neutral setting of the rotary shaft and the means, with which the displacement torque can be exerted on the second end of the rotary shaft can be performed. So the rotary shaft can be turned relative and independently from the neutral position setting detent sleeve exactly to the rotational position in which the conveying volume of the hydrostatic piston pump is zero. Simultaneously the servo pressure fluid flows are adjusted such that the servo piston is held in a position that guarantees the zero-displacement volume of the hydrostatic piston pump. This must not be necessarily the geometric or theoretical mid-position of the servo piston in the servo cylinder, as production tolerances and/or the forces of the servo piston centring springs must not be equal. Finally, the rotary shaft is brought into a position in which he indicates reliably the neutral position of the hydrostatic piston pump, thereby balancing the production tolerances of all parts of the displacement control device as well as of the mounting and production tolerances of the feedback element relative to the displacement element and the displacement control device.

In a preferred, simple embodiment a lever is fixed to the second end of the rotary shaft either directly or indirectly such that, in the detached situation the rotary shaft and the detent sleeve can be rotated independently and relative to one another. Also, in this condition the lever can be adjusted to the "Neutral indication" on the housing or on the detent sleeve as the latter is held in neutral position abutting against the abutment area on the detent sleeve. At the same time the rotary shaft can be rotated to its neutral position as well, in which the hydraulic pressures guided to both sides of the servo pistons are balanced in such a manner that the displacement element of the hydrostatic pump is held in the neutral position, in which the hydrostatic pump does not show any displacement and therefore its conveying volume is equal to zero.

In a preferred embodiment of the invention the abutment area for assuring the rotational fixed position of the detent sleeve is a flattened portion formed on the detent sleeve, onto which a flat front face of the sliding element can abut fully-faced. Thus, when the rotary shaft and the detent sleeve are deflected out of the neutral position in a rotational motion around the rotary shaft axis, the sliding element do no longer abuts planar on the abutment area since they are in a line contact at one end region of the abutment area dependent upon the direction of rotation of the rotary shaft together with the detent sleeve. Alternatively, the abutment area can be constituted by a depression on the detent sleeve into which, in the neutral position of the displacement control device, a convex surface of the sliding element can engage in a resilient manner. Thus, when the rotary shaft and the detent sleeve are deflected out of the neutral position in a rotational motion around the rotary shaft axis the sliding element is pressed away from the rotary shaft axis by the greater diameter of the detent sleeve beneath the depression.

In another embodiment the abutment area is a recess formed in the detent sleeve into which a protrusion of the sliding element can be inserted. Preferably the protrusion of the sliding ele-ment engages laterally with the recess in the detent sleeve by means of a resilient force. There-by the zero position of rotational motions of the detent sleeve is reliably indicated, when the protrusion abuts planar on the recess. For all of these embodiments it can be preferred further that the sliding element and the recess or the depression are designed such that the sliding element fixes the detent sleeve also in axially direction with regard to the rotary shaft, at least when the sliding element engages with the detent sleeve.

In operational conditions of the hydraulic machine a torque is applicable to the second end of the rotary shaft in order to rotate the rotary shaft and the detent sleeve fixed to the rotary shaft, and in order to open servo lines for guiding hydraulic fluid under pressure onto one side of the servo piston of the servo displacement unit and for guiding hydraulic fluid from the other side of the servo piston to tank. Thereby the servo piston is changed in its position and deflects the displacement element of the hydraulic machine, i.e. changes the displacement volume of the same. The invention is especially applicable when the hydraulic piston pump is of the axial construction type, in particular of the swashplate or the bent axis version. Hereby, the correspon-ding displacement element preferably can be swivelled to positive and/or negative displacement angles.

For this purpose, the torque onto the second end of the rotary shaft can be generated manually, mechanically, pneu-matically, electro-mechanically or hydraulically. In one simple embodiment a lever is fixed to the second end of the rotary shaft. This lever permits an easy and finely control-lable manual rotation of the rotary shaft for a precise setting of the displacement control device.

For example, in a hydraulic axial piston pump with a tiltable swashplate the motion of the swashplate is transmit-ted back to the displacement control unit via a feedback element mounted on the displacement element, e.g. a feed-back-pin which eccentrically engages a feedback sleeve of the displacement control device. According to the invention this feedback sleeve is mounted coaxial to the rotary shaft and can be rotated, driven by means of the feedback pin, in the housing independently and relative to the rotary shaft around the rotary shaft axis. The feed-back sleeve further comprises several openings which can be brought on the outer side in fluid connection with one charge pressure line feeding hydraulic fluid under pressure to the displace-ment control device, with another servo pressure lines for guiding hydraulic fluid from the servo unit to a low pressure region, i.e. discharging hydraulic fluid from the non-charged servo piston side. On the inner side the first end of rotary shaft is capable to enable a fluid connection between the charge pressure line and one of the servo pressure lines, disabling at the same time a fluid connection of the charge pressure line to the other servo line thereby impeding permanently a fluid connection between the charge pressure line and the discharge line.

Hence, in a preferred embodiment according to the inven-tion, when a torque is applied onto the second end of the rotary shaft, the first end of the rotary shaft which protrudes into the feedback sleeve opens one opening allocated to one servo line and closes another opening allocated to a second servo line by rotating the feedback sleeve. By that one servo piston side is charged with hydraulic fluid under pressure, and from the other servo piston side hydraulic fluid is discharged to an area with low pressure. This causes the servo piston, and therewith the displace-ment element, to change its position, thereby changing the displacement volume of the hydraulic machine. When the displacement element is moved, the feedback element mounted thereon moves also and rotates the feedback sleeve around the rotary shaft, thereby closing the discharge line. In this way the torque applied to the second end of the rotary shaft is fed back to the displacement control device according to the invention.

In implementing this preferred embodiment of a displace-ment control device the feedback pin axis is selected offset to the axis of rotation of the displacement element in order to transmit a tilting movement of the displacement element via the feedback pin to the feedback sleeve. This offset is preferably different from a distance between the feedback pin axis and the rotary shaft axis. This provides for a transmission relation of the rotational/tilt motion of the displacement element and the feedback sleeve rotation. Preferably the offset of the feedback pin axis is bigger than the distance between the feedback pin axis and the rotary shaft axis. By means of this, the rotational angle of the rotary shaft can be selected bigger than the angle of rotation or tilt of the displacement element, which is commanded by the angle set at the rotary shaft. This provides for a better, smoother and less nervous (less agitated) adjustability of the hydraulic machine setting.

In an alternative embodiment according to the invention an eccentric pin having an eccentric axis is located at the first end of the rotary shaft, wherein the eccentric axis provides a rotational axis for a feedback link. A first end of the feedback link is coupled to a control spool and a second end comprises an elongated hole section for receiving a second end of the feedback element attached to the displacement element. In this way a motion of the displacement element causes a rotation of the feedback link around the eccentric axis of the eccentric pin. Due to this rotation a control spool is shifted, changing accordingly the supply of charge pres-sure guided to one side of the servo piston. On the other hand, the eccentric pin causes the feedback link between the feedback element of the displacement element and the control spool due to its eccentricity to move the control spool if the rotary shaft is rotated around its rotational axis. In this case the elongated hole section of the feedback link serves as center of rotation around the rotational axis of the feedback element, i.e. a turning of the rotary shaft displaces the feedback link and thereby the control spool.

With the displacement of the control spool, openings for charging or discharging of servo lines are changed in size. This leads to a different pressure delta on both sides of the servo piston thereby displacing the servo piston. As commonly known by a person skilled in the art, this has the effect to move the displacement element of the hydraulic axial piston pump causing thereby a change in displacement volume of the hydraulic axial piston pump. Due to the displacement or swiveling of the displacement element, the feedback element attached to the displacement element moves as well. As the feedback element engages with the feedback link connecting the feedback element and the control spool rotationally via the eccentric axis, the curvature-like motion of the feedback element causes a motion of the control spool too.

According to the invention, this mechanic feedback is done via the feedback link connecting the feedback element on the displacement element with the control spool, wherein the feedback link is rotationally supported at his first end at the control spool and with his second end via an elongated hole section on the feedback element. In-between the two ends the feedback link the eccentric pin is rotationally supported, wherein the eccentric pin is provided at the first end of the rotary shaft of the manual displacement control device. Thereby, either the bearing of the second end of the feedback element at the elongated hole section or the bearing of the eccentric pin in the mid-portion of the feedback link serves as a center of rotation causing a corresponding motion of the control spool, as either the second end of the feedback element moves, when the displacement element is displaced by means of the servo adjusting unit, or the eccentric pin moves, when the rotary shaft is rotated.

In the same manner as described with the above mentioned alternative embodiment comprising a feedback sleeve to feed back the position of the displacement element, the rotary shaft of the manual displacement control device can be rotated relative to the detent sleeve in an independent manner if the fastening nut joining together the detent sleeve and the rotary shaft is loose-ned. When the fixing of the detent sleeve and the rotary shaft is loosened, a precise neutral position setting individually adapted to the hydraulic axial piston pump is possible, when the hydraulic axial piston pump does not show any displacement volume. If, for instance, a lever is attached to the detent sleeve or to the rotary shaft, this lever can be brought also to a neutral position indicating position, if necessary. Hence, with the inventive neutral setting device, it is possible in an easy, simple, reliable and quick manner to adjust/align the neutral position of all involved parts, i.e. the displacement element with its feedback element, the control spool, the servo piston and the lever by simply loosening the nut fixing the detent sleeve to the rotary shaft. This simple, easy and quick neutral setting can be applied to all displacement control units/devices having a mechanical feedback of the swashplate position to the displacement control device. Furthermore manufacturing tolerances and assembly tolerances can be compensated at the same time.

BRIEF DESCRIPTION OF THE DRAWINGS

Exemplary embodiments of a displacement control device according to the invention are depicted in more detail in the appended drawings, which do not limit the scope of the inventive idea. All features of the disclosed and illustrated embodiments may be combined in any desired combination with one another within the scope of the invention. For this purpose.

DETAILED DESCRIPTION

Figure 1:
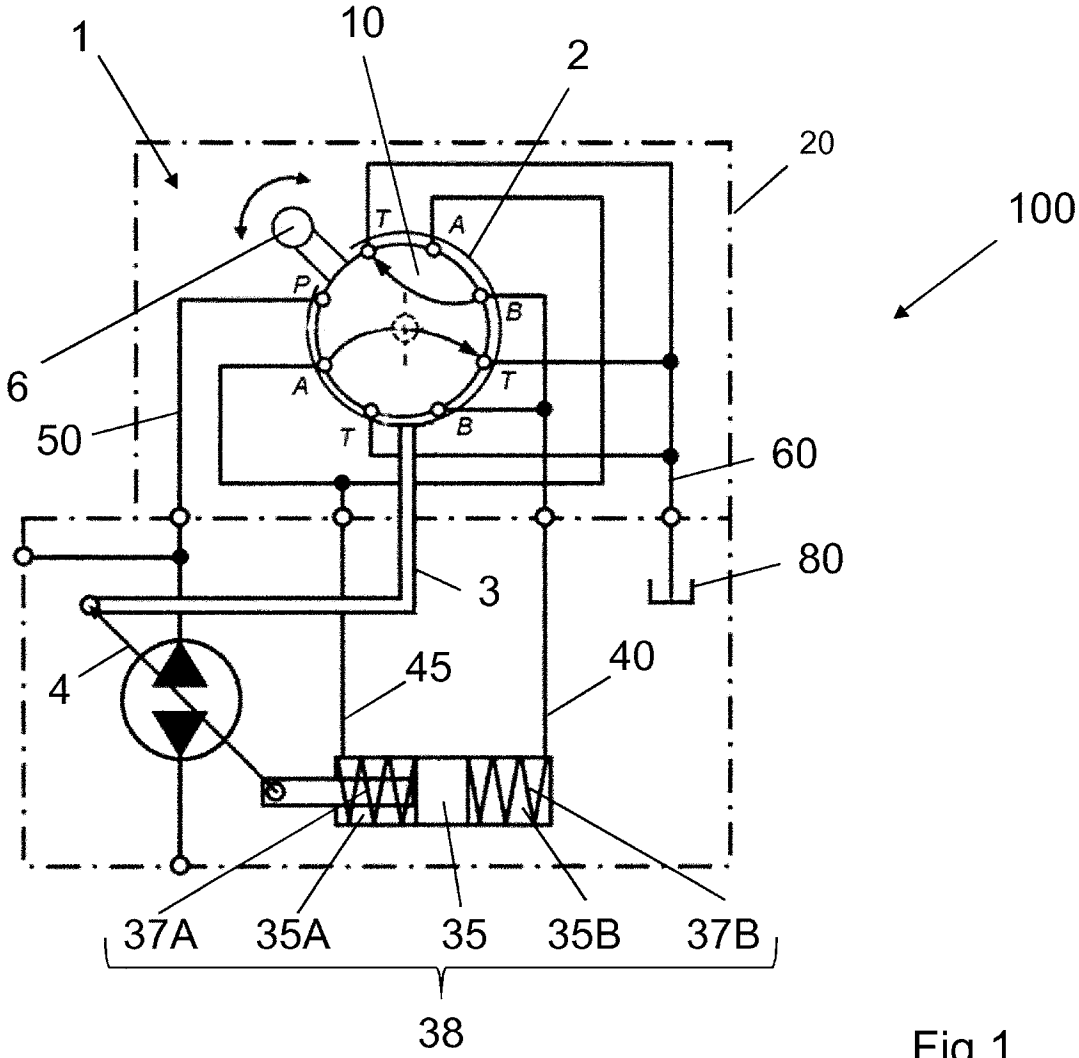
FIG. 1 shows schematically a hydraulic circuit diagram of an exemplary hydraulic pump with a displacement control device according to invention.

FIG. 1 shows schematically a hydraulic circuit diagram of an exemplary hydraulic pump 100 with a displacement control device 1 according to invention. The displacement control device 1 is fed with hydraulic fluid under pressure via charge pressure line 50 leading from the hydrostatic piston pump 100 to charge pressure port P of the displacement control device 1. The displacement control device 1 according to FIG. 1 is shown in the neutral position in which the hydrostatic piston pump 100 does not show any displacement volume. Hereby servo pressure ports A and B are both connected via corresponding discharge ports T to discharge line 60 connected to tank 80. Thus both servo piston sides 35A and 35B of servo piston 35 are at the same pressure level, here at tank pressure level, and the servo piston 35 is centered via its servo piston springs 37A and 37B. Hence, displacement element 4 of hydrostatic piston pump 100 is in its neutral positon too, and no displacement volume flow rate is generated by hydrostatic piston pump 100. This neutral position of displacement element 4 is fed back via feedback element 3 to displacement control device 1.

Figure 2:
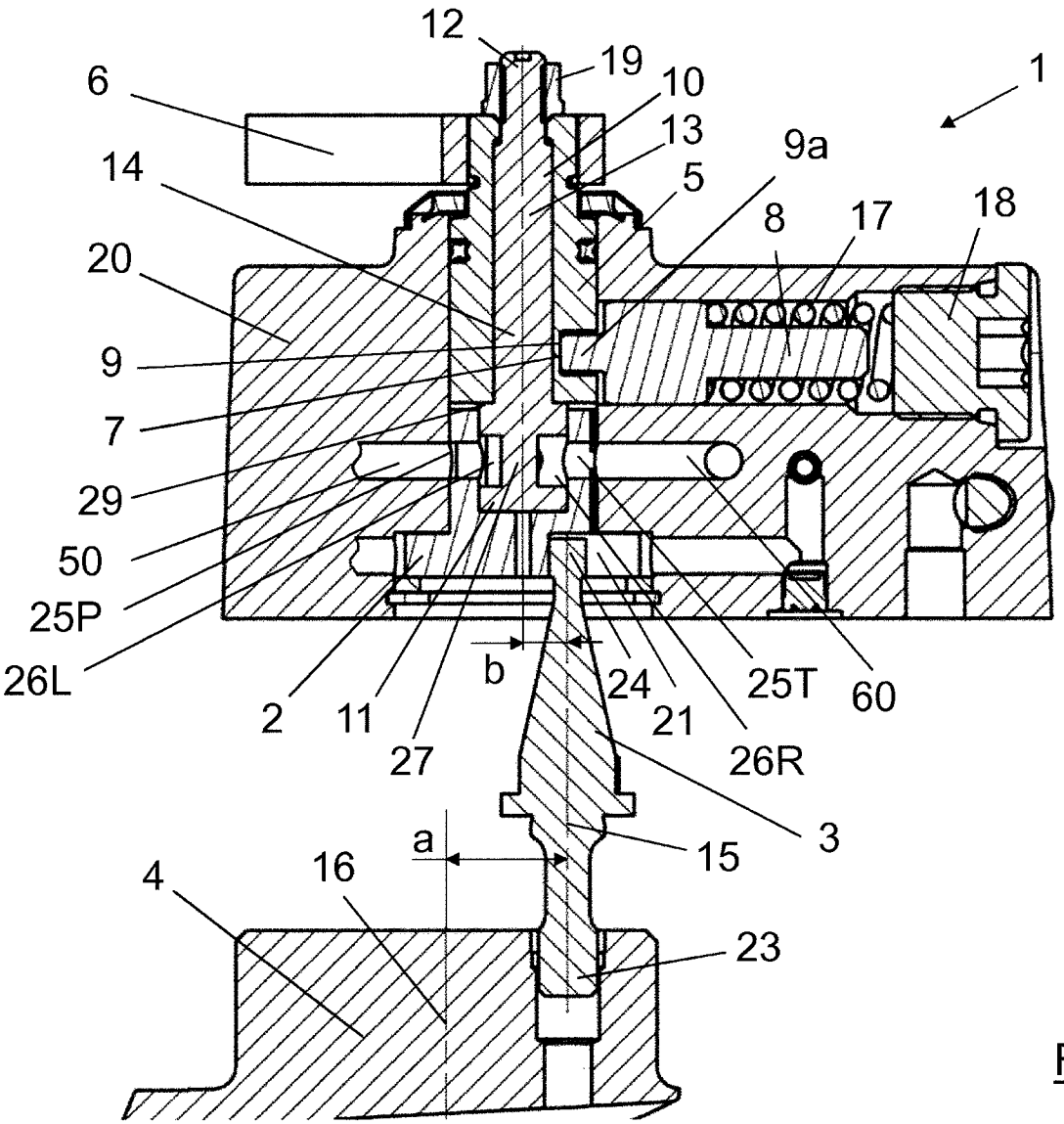
FIG. 2 shows a cross section of an exemplary embodiment of a displacement control device according to the invention with a first alternative to feedback the displacement element position to the displacement control device.

FIG. 2 shows an exemplary embodiment of a displacement control device 1 according to the invention in cross-section. The displacement control device 1 is housed in a housing 20, preferably not part of the hydraulic machine housing. The shown hydraulic machine of this embodiment is exemplarily of the swashplate type. For reason of simplicity only, part of a displacement element 4, here a swashplate, and a feedback element 3 associated therewith is shown. The displacement element 4, here the swashplate, is tiltable in two directions about a tilt axis 16, wherein the tilt angle determines the volumetric flow rate of the hydraulic machine. These features and the manner of operation of such a hydraulic machine are well known to a person skilled in the relevant art, such that further explanations thereto can be omitted at this point. In the following, the terms "displacement element" and "swashplate" will be used synonymously with the same reference numeral 4.

Figure 3:
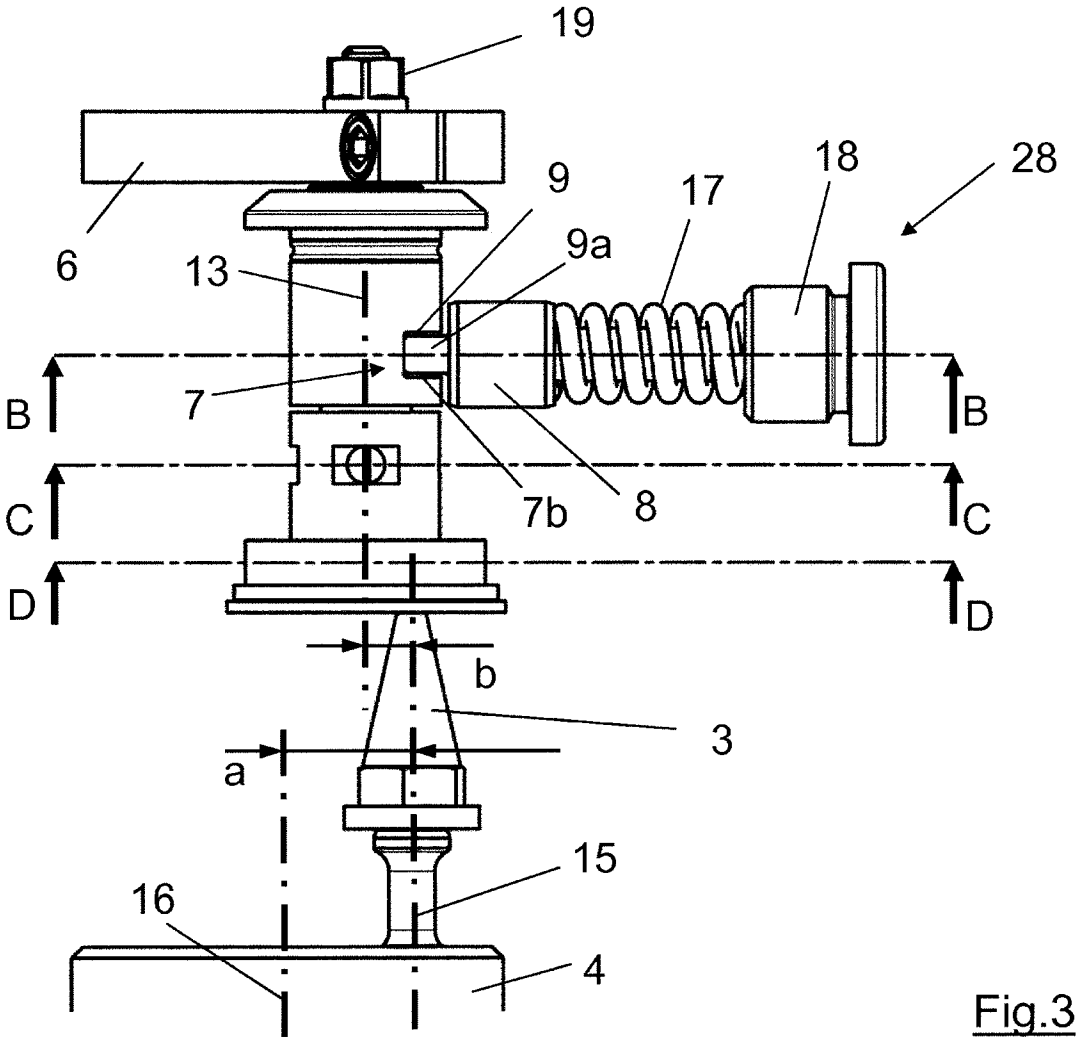
FIG. 3 depicts a side view of the displacement control device of FIG. 2 without housing.
Figure 6:
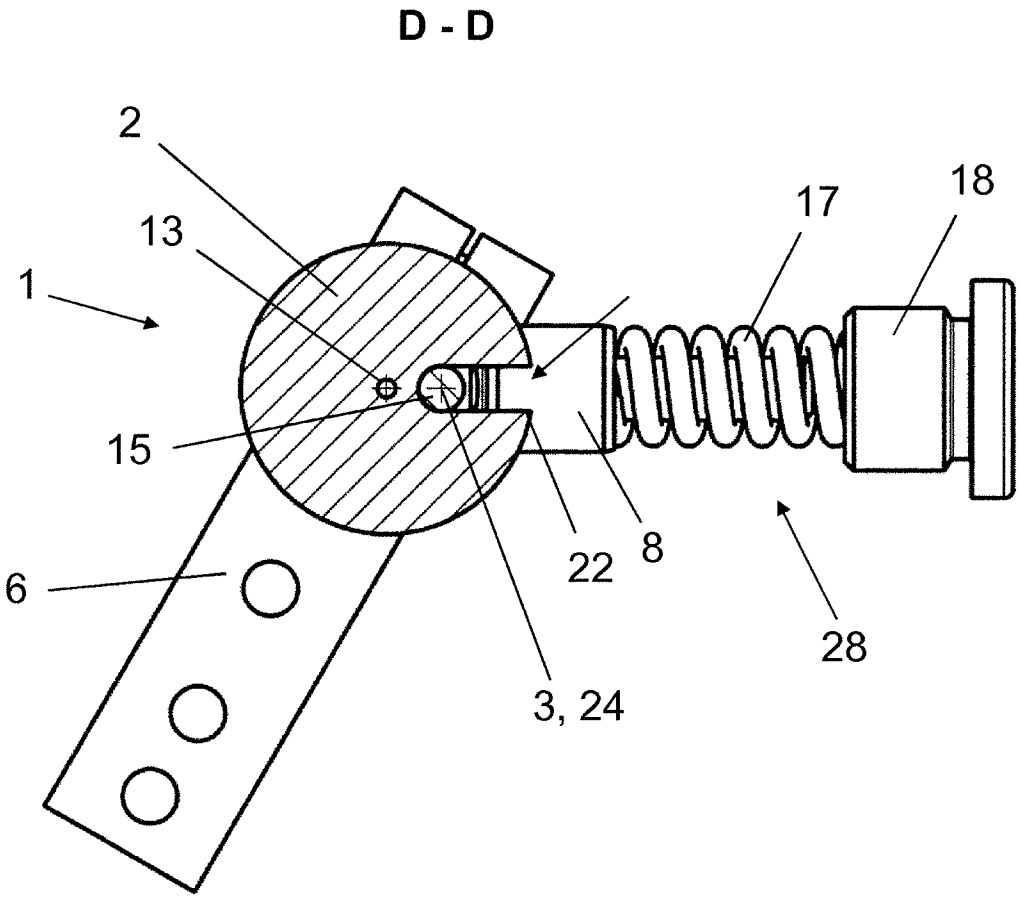
FIG. 6 is a partial cross-section along the plane D-D of FIG. 3.

Feedback element 3 which is generally pin or rod shaped and having a longitudinal axis 15, is fixedly attached with a first end 23 to the swashplate 4. Thus, the feedback element 3, in particular the first end 23 participates in any tilt motion of the swashplate 4 with a curvature-like motion. The longitudinal axis 15 of feedback element 3 is laterally offset from the tilt axis 16 of swashplate 4 by a distance "a" as shown in FIGS. 2 and 3. The second end 24 of feedback element 3 extends into the interior of the displacement control device 1 and engages a feedback sleeve 2 which is rotatable supported in housing 20. Feedback sleeve 2 has a slot 21 extending in a radial direction, in which slot 21 the second end 24 of feedback element 3 is slidable, as depicted in FIG. 6, in order to enable the curvature-like motion of the feedback pin 3, i.e. of second end 24 of feedback pin 3 within the feedback sleeve 2, and transfer the curvature-like motion into a rotational motion of feedback sleeve 2 around the rotary shaft axis 13. In an inner bore of feedback sleeve 2 a first end 11 of a generally cylindrical rotary shaft 10 is held rotatable around the rotary shaft axis 13 as well. Thereby, feedback sleeve 2 and rotary shaft 10 can rotate independently from each other.

Figure 5:
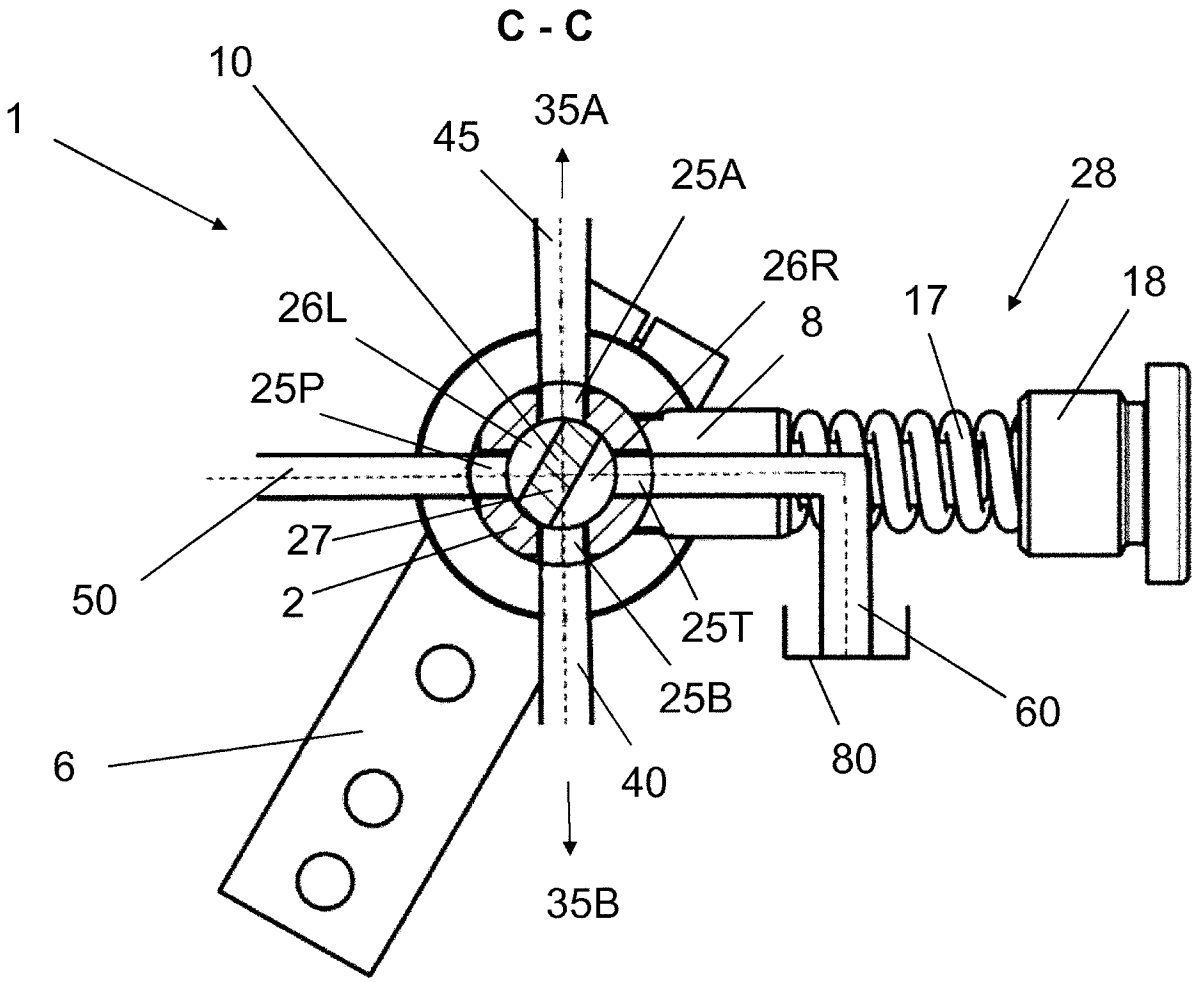
FIG. 5 is a partial cross-section along the plane C-C of FIG. 3.

Feedback sleeve 2 has several ports 25A, 25B, 25P and 25T which can be put in fluid connection with charge pressure line 50, discharge pressure line 60 and with servo pressure lines 40 and 45 all located partially within housing 20 of displacement control device 1. The lines 40, 45, 50 and 60 are connected with the respective ports 25A, 25B, 25P and 25T, what is shown in FIG. 5 in greater detail. The first end 11 of rotary shaft 10 comprises two recesses 26L and 26R in the region of the ports 25A, 25B, 25P and 25T. Between the recesses 26L and 26R a bridge 27 of rotary shaft 10 acts as a barrier or seal between charge pressure port 25P and the discharge port 25T. Port 25A and 25B connected to servo pressure lines 40 and 45 are not visible in FIG. 2 as they are located in the back respectively in the front of the bridge 27. In the situation of displacement control device 1 shown in FIG. 2, which again corresponds to the neutral position or zero position of displacement control device 1, no fluid flow is possible between one of servo pressure lines 40 or 45 and charge pressure line 50. Nor a fluid communication of the other one of servo pressure lines 40 or 45 with discharge line 60 is enabled. This will be explained in more detail with FIG. 5 below.

The mid portion 14 of rotary shaft 10 is surrounded by a detent sleeve 5. A second end 12 of rotary shaft 10 protrudes outside of housing 20. This second end 12, for instance, as shown in the embodiment of FIG. 2, is threaded and can be fixedly connected to the adjoining end of detent sleeve 5 by means of a nut or counter-nut 19, wherein the detent sleeve 5 abuts with its other end on a shoulder 29 on rotary shaft 10 beneath the first end 11 of rotary shaft 10. According to the embodiment of FIG. 2, a lever 6 is attached to detent sleeve 5 which enables the rotation of detent sleeve 5 together with rotary shaft 10 relative to feedback sleeve 2. In operation of the hydraulic device rotary shaft 10 and detent sleeve 5 are jointly fixed together in order that a torque applied to the second end 12 of rotary shaft 10 causes the rotary shaft 10 to rotate together with detent sleeve 5. As it will be explained in more detail with the description of FIG. 5, a rotation of the rotary shaft 10 enables a fluid connection between the charge pressure line 50 and of servo pressure lines 40 or 45 and another fluid connection of discharge line 60 with the other one of servo line 40 or 45 in order to command the displacement element 4 of the hydrostatic piston pump 100 to another displacement volume flow rate.

Loosening of nut 19 enables a free and relative rotation of rotary shaft 10 with respect to detent sleeve 5, which permits a precise adjustment of the neutral position of a displacement control device 1 according to the invention, as the detent sleeve 5 is held in a fixed rotational and axial position by a sliding element 8. For this purpose, detent sleeve 5 comprises an abutment area 7 into which the sliding element 8 can engage. Preferably the abutment area 7 shows a flattened portion 7*a* onto which a flat front face 8*a* of the siding element 8 is pushed resiliently by means of a spring 17. Thereby spring 17 is held pre-stressed in housing 20 by a cap or—in general—by a stopper 18, preferably screwed-in in the housing 20.

As can be derived from FIG. 2, the sliding element 8 is pushed towards the stopper 18 when a torque is applied to the second end 12 of rotary shaft 10. Here, for instance, by means of lever 6. When the detent sleeve 5 is rotated the flat front face 8*a* leaves the planar contact on the flattened portion 7*a*. This planar contact is transferred by the rotational motion of the detent sleeve 5 to a linear contact. As this linear contact is eccentric to the rotary shaft axis 13, the resilient force of spring 17 generates a restoring torque via the eccentric line contact. This restoring torque is used to hold the detent sleeve in place, when the rotary shaft 10 has to be adjusted to the zero or neutral position of the hydrostatic axial piston pump in a first adjustment process when putting the hydrostatic axial piston pump into service for the first time or after maintenance.

In the following figures and description, the same reference numerals will be used where appropriate to denote similar parts, or features, in order to facilitate an explanation of the invention.

FIG. 3 depicts a side view of the displacement control device 1 of FIG. 2, however, without the housing 20. Swashplate 4 and feedback element 3 are shown in operation condition. Of particular note are the positions and geometrical relationships of the distance "a" of the longitudinal axis 15 of the feedback element 3 and the tilt axis 16 of the displacement element 4 as well as the offset "b" of the longitudinal axis 15 of the feedback element 3 and the axis of rotation 13 of the feedback sleeve 2. Thereby the distance "a" is larger than the offset "b" which means that a small change in the tilt angle of the swashplate 4 cause a big feedback response to the feedback sleeve 2, which means further that the displacement control device 1 according to the invention allows big rotational angles at the rotary shaft 10 for commanding the displacement volume of the hydrostatic piston pump 100. This finally provides for a precise, smooth (i.e. not agitated) and better controllable control of the hydrostatic piston pump as it is not oversensitive.

In FIG. 3 are shown three planes B-B, C-C and D-D that indicate the respective position of the detailed cross-sections of the displacement control device 1 of FIG. 3 that are depicted in the following FIGS. 4 to 6.

Figure 4:
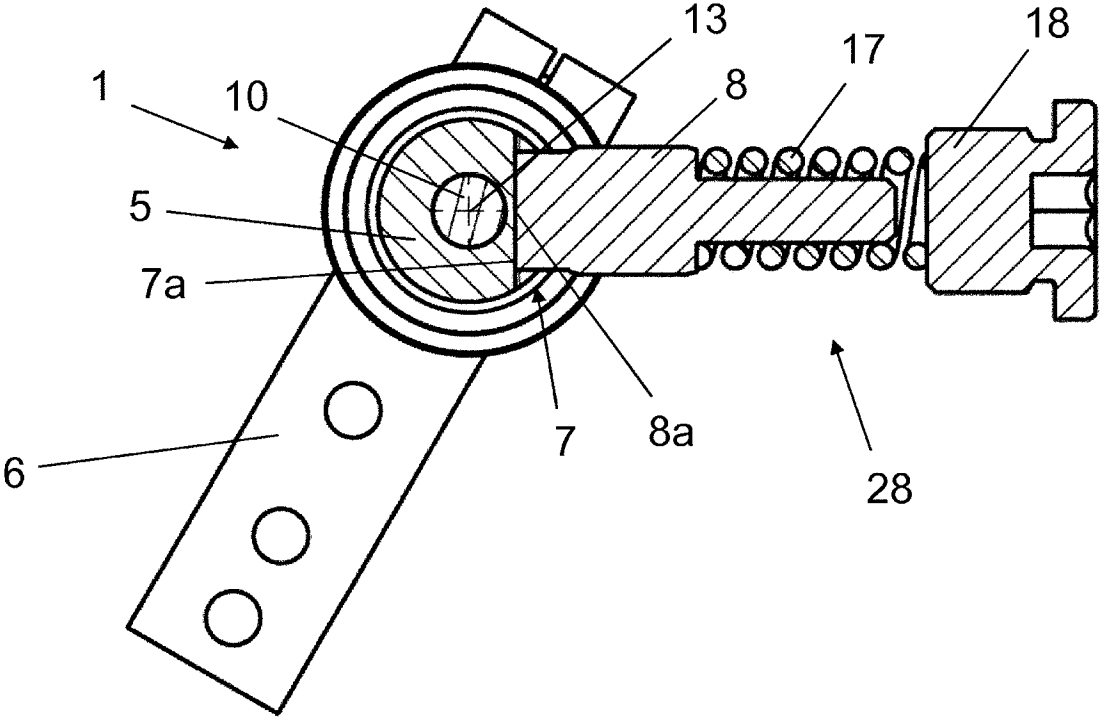
FIG. 4 is a partial cross-section along the plane B-B of FIG. 3

FIG. 4 depicts a cross section taken in plane B-B of FIG. 3, i.e. at the mid-level of a reset mechanism 28, comprising sliding element 8, spring 17 and stopper 18. Clearly visible is an abutment area 7 with a flattened portion 7*a* of a recess or depression 7*b* in detent sleeve 5 against which a flat front face 8*a* of sliding element 8 abuts in full planar contact. In this configuration the forces acting on detent sleeve 5 and rotary shaft 10 are balanced. Rotation of detent sleeve 5 with respect to reset mechanism 28 causes a deviation from the full contact between the flattened portion 7*a* located at detent sleeve 5 and the flat front face 8*a* of sliding element 8. Depending on the direction of the rotation, contact is in this case only between the edges or peripheral regions of the flattened portion 7*a* and the flat front face 8*a*. As spring 17 exerts a force via sliding element 8 on detent sleeve 5, a restoring momentum acts on detent sleeve 5 that counteracts the applied rotation. This is due to the position of the line contact between detent sleeve 5 and sliding element 8, which is laterally offset from the common axis of rotation 13 of detent sleeve 5 and rotary shaft 10. Thus, reset mechanism 28 tends to restore the neutral position state of the displacement control device 1 shown in FIG. 3.

In FIG. 5 a different cross section taken in plane C-C is shown. This cross-section is taken at the level of ports 25A, 25B, 25P and 25T in feedback sleeve 2, wherein the recesses 26L and 26R and the bridge 27 of rotary shaft 10 can be seen as well. In the operational condition shown in FIG. 5 the solid section 27/bridge 27 of rotary shaft 10 together with the recess 26L left of the bridge 27 enables a hydraulic fluid connection of the charge pressure line 50 with the servo pressure line 45 leading, for instance, to servo piston side 35A (see FIG. 1). This position of the bridge 27 also enables together with the recess 26R on the right side of the bridge 27 discharging of hydraulic fluid from the other servo piston side, here for instance, to servo piston side 35B (see FIG. 1) via servo discharge line 60 to a region with lower pressure, e.g. to tank 80. The situation shown in FIG. 5 is just after rotating lever 6 in one direction around rotational axis 13 of rotary shaft 10. The feedback sleeve 2 is still its initial position, however, feedback sleeve 2 will be turned by means of the feedback element 3 (not shown in FIG. 5), for instance, in the counter-clockwise direction until the discharging of the non-charged servo piston side, here servo piston side 35B, is disabled. The position of the rotary shaft 10 and therewith of bridge 27 will remain as shown in FIG. 5, however, the fluid cross section between charge pressure port 25P and servo pressure port 25A will be reduced due to the rotation of the feedback sleeve 2.

FIG. 6 shows a third cross section taken in plane D-D of FIG. 3 taken at the level of feedback sleeve 2. The second end 24 of feedback element 3 extends into slot 21 of feedback sleeve 2, and is in a slide-able but close contact with the sidewalls 22 of slot 21. As the feedback element 3 moves in a curvature-like motion, e.g. a circular arc centred on the axis of tilt 16 of swashplate 4 slot 21 is necessary to compensate the change in the distance between the axis 15 of feedback element 3 and the common axis of rotation 13 of feedback sleeve 2 and rotary shaft 10 upon any displacement of feedback element 3.

Figure 7:
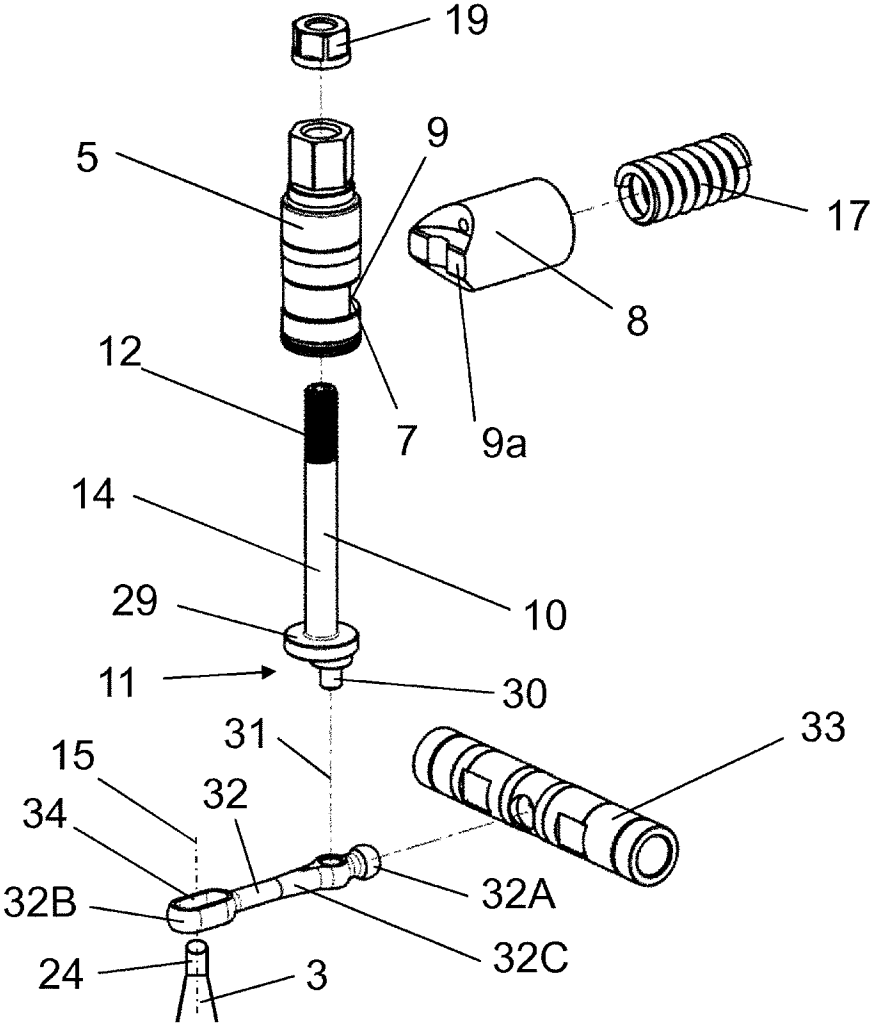
FIG. 7 shows in an exploded view another embodiment of a displacement control device according to the invention with a second alternative to feedback the displacement element position to the displacement control device.

FIG. 7 depicts, in an exploded view, another embodiment of a displacement control device 1 according to the invention. Therewith a second alternative for feeding back the position of the displacement element 4 to the displacement control device 1 is depicted. However, the neutral setting adjustability allowing a relative and independent rotational motion between the rotary shaft 10 and the detent sleeve 5 when loosening the nut 19 is maintained as descript above with FIGS. 2 and 3. This is shown in the upper part of FIG. 7 in an described manner by means of the exploded view. An loosened nut 19 does not press the detent sleeve 5 any longer on a shoulder 29 on rotary shaft 10 separating the mid-portion 14 of rotary shaft 10 from the first end 11 of rotary shaft 10. Thereby, the rotary shaft 10 can be rotated within the longitudinal bore of detent sleeve 5, whilst detent sleeve 5 is hold rotationally fixed in position by means of the spring forces of spring 17. Thus, if the rotary shaft 10 is brought into its neutral position the nut 19 can be tighened (again) to fix and define the neutral position of the inventive displacement control device 1.

The rotary shaft 10 is in its neutral position, when the displacement element 4 is its neutral position in which the hydraulic axial piston unit 100 do show any displacement volume. The displacement element 4 is situated in the neutral position if the pressures acting on both sides 35A and 35B of the servo piston 35 are balanced (see FIG. 1). In the embodiment of FIG. 7 a feedback link 32 feeds back to the control spool 33 the position of the feedback element 3 attached to displacement element 4. Control spool 33 serves in this embodiment for opening and closing the servo lines 40 and 45 as well as servo charge line 50 and servo discharge line 60 in an adequate manner to forward the demand set at the displacement control device 1 to the servo adjusting unit 38 (see FIG. 1). For this purpose an eccentric pin 30 is located at the first end 11 of rotary shaft 10. This eccentric pin 30 is rotatable supported around a rotational axis 31 in the mid-portion 32C of the feedback link 32. An elongated hole section 34 at the second end 32B of the feedback link 32 is engaged rotatable free with the second end of feedback element 3 attached to displacement element 4. On the other side the feedback link 32 is coupled in an articulated manner with its first end 32A to the control spool 33, such that any motion of the feedback element 3 or the eccentric pin 30 due to a rotation of the displacement element 4 or the rotary shaft 10 is transmitted to control spool 33. Thereby either the rotational axis 31 of the eccentric pin 30 or the longitudinal feedback element axis 15 constitutes the axis of rotation.

By means of this arrangement the feedback link 32 is in an defined position in the zero displacement volume condition of the hydraulic axial piston unit 100 and is capable to provide via the rotational axis 31 and the eccentric pin 32 the neutral position for rotary shaft 10. As can be derived from FIG. 7 this neutral position of rotary shaft 10 can be aligned with the rotational neutral position of detent sleeve 5 simply by openning and tighen nut 19. The neutral position of the detent sleeve 5 is kept fixed by means of the sliding element 8 which is prestressed by spring 17.

When implementing the invention the eccentric pin 30 can be formed integrally at the first end 11 of the rotary shaft 10 or can be a separate part attached to the rotatory shaft 10, for instance at shoulder 29. Elongated hole section 34 can be an oblong hole in the feedback link 32 or e.g. for assembling reasons in the shape of an U. Thereby an elongated hole is preferred due to the curvature-like motion the feedback element 3 at the displacement element 4 can perform. In another preferred embodiment of the invention the elongated hole section 34 is capable to exert an elastic force onto the second end 24 of the feedback element 3 for providing a clearance-free engagement of the second end 24 of the feedback element 3 and the elongated hole section 34. This can be realized e.g. when applying a U-shaped elongated hole section by inserting a spring or other elastic material into the elongated hole section.

Finally with the inventive displacement control device 1 a quick, simple, robust and comfortable neutral setting device is provided, which reliable admits the individual neutral setting of a hydraulic axial piston unit thereby compensating manufacturing and assembly tolerances within the whole hydraulic axial piston unit.

While the present disclosure has been illustrated and described with respect to particular embodiments thereof, it should be appreciated by those of ordinary skill in the art that various modifications to this disclosure may be made without departing from the spirit and scope of the present disclosure.

What is claimed is:

1. A displacement control device for variably adjusting the displacement volume of a hydraulic axial piston pump comprising a rotary shaft mounted rotatable in a housing around a rotary shaft axis of the rotary shaft, said rotary shaft having a first end and a second end, wherein the rotary shaft is configured to open and close servo pressure lines arranged within the housing when a torque is applied to the second end, which protrudes outside of the housing, wherein the servo pressure lines are configured to conduct hydraulic fluid to and from a servo adjusting unit capable of adjusting the displacement volume of the axial piston pump, said rotary shaft further comprising a mid-portion located between the first end and the second end, wherein a detent sleeve is positioned concentric to the rotary shaft axis in the mid-portion of the rotary shaft, the detent sleeve comprising an abutment area onto which, in a neutral position of the displacement control device, a sliding element abuts, the sliding element being mounted pre-stressed in the housing and exerting a resilient force onto the detent sleeve transverse to the rotary shaft axis, wherein the detent sleeve in operating conditions of the displacement control device, is rotatably fixed to the rotary shaft and turns with the rotary shaft, wherein, for neutral position adjustments in non-operating conditions, the detent sleeve and the rotary shaft are detachable from each other, such that the rotary shaft is configured to be turned independently within the detent sleeve which is held in its neutral position by the resilient force of the sliding element onto the abutment area.

2. The displacement control device according to claim 1, wherein the abutment area is a flattened portion formed on the detent sleeve onto which a flat front face of the sliding element is configured to abut fully-faced in the neutral position of the displacement control device.

3. The displacement control device according to claim 2, wherein the sliding element and the abutment area are designed such that the detent sleeve is fixed axially with regard to the rotary shaft when the sliding element engages with the detent sleeve.

4. The displacement control device according to claim 2, wherein the abutment area is a recess formed in the detent sleeve into which a protrusion of the sliding element is configured to be inserted.

5. The displacement control device according to claim 4, wherein the sliding element and the recess are designed such that the detent sleeve is fixed axially with regard to the rotary shaft when the sliding element engages with detent sleeve.

6. The displacement control device according to claim 1, wherein the abutment area is a depression into which, in the neutral position of the displacement control device, a convex surface of the sliding element is configured to engage.

7. The displacement control device according to claim 6, wherein a protrusion of the sliding element engages the detent sleeve laterally and thereby prevents rotational motion of the detent sleeve.

8. The displacement control device according to claim 7, wherein the sliding element and the depression are designed such that the detent sleeve is fixed axially with regard to the rotary shaft when the sliding element engages with the detent sleeve.

9. The displacement control device according to claim 1, wherein the abutment area is a recess formed in the detent sleeve into which a protrusion of the sliding element is configured to be inserted.

10. The displacement control device according to claim 4, wherein the sliding element and the recess are designed such that the detent sleeve is fixed axially with regard to the rotary shaft when the sliding element engages with the detent sleeve.

11. The displacement control device according to claim 1, wherein a feedback sleeve is attached to the first end of rotary shaft, wherein the feedback sleeve is rotatable with respect to the housing and with respect to the rotary shaft, wherein a feedback element attached to a displacement element of the hydraulic axial piston pump is capable of feeding back the position of the displacement element of the hydraulic axial piston pump and engages with the feedback sleeve eccentrically, such that a motion of the displacement element and therefore of the feedback element causes a rotation of the feedback sleeve relative the rotary shaft, thereby opening and/or closing the servo pressure lines.

12. The displacement control device according to claim 11, wherein an offset of a feedback element axis to a tilt axis of the displacement element is different from a distance of the feedback element axis to the rotary shaft axis.

13. The displacement control device according to claim 12, wherein the offset is bigger than the distance.

14. The displacement control device according to claim 1, wherein an eccentric pin having an eccentric axis is located at the first end of the rotary shaft, wherein the eccentric axis provides a rotational axis for a feedback link, whose first end is coupled to a control spool and whose second end comprises an elongated hole section for receiving a second end of a feedback element attached to a displacement element, such that a motion of the displacement element causes a rotation of the feedback link and shifts the control spool.

15. The displacement control device according to claim 14, wherein the eccentric pin is integrally formed on the first end of the rotary shaft.

16. The displacement control device according to claim 14, wherein the elongated hole section is U-shaped.

17. The displacement control device according to claim 14, wherein the elongated hole section is capable of exerting an elastic force onto the second end of the feedback element for providing a clearance-free engagement of the second end of the feedback element and the elongated hole section.

18. The displacement control device according to claim 1, wherein the hydraulic axial piston pump is of the swashplate type or the bent axis type, wherein a displacement element of the hydraulic axial piston pump is configured to be swiveled to positive and/or negative displacement angles.

19. The displacement control device according to claim 1, wherein the torque applied to the second end of the rotary shaft is configured to be generated manually, mechanically, pneumatically, electro-mechanically or hydraulically.

20. The displacement control device according to claim 1, wherein a lever is fixed to the second end of the rotary shaft or is fixed to the detent sleeve.

* * * * *